US005624168A

United States Patent [19]

Licciardello, Sr.

[11] Patent Number: 5,624,168

[45] Date of Patent: Apr. 29, 1997

[54] CABINET MOUNTING APPARATUS

[76] Inventor: Morris F. Licciardello, Sr., 236 Mill St., Bristol, Pa. 19007

[21] Appl. No.: 294,904

[22] Filed: Aug. 24, 1994

[51] Int. Cl.[6] ..... A47B 96/06

[52] U.S. Cl. ..... 312/245; 211/94; 248/225.21

[58] Field of Search ..... 312/245, 246, 312/247; 211/94, 88; 248/225.1, 225.2; 52/27, 36.4, 36.5

[56] References Cited

U.S. PATENT DOCUMENTS

| | | | |
|---|---|---|---|
| 2,708,147 | 5/1955 | Duggan et al. | 312/245 X |
| 3,950,049 | 4/1976 | Drass | 312/245 |
| 4,008,872 | 2/1977 | Thompson | 211/88 X |
| 4,165,852 | 8/1979 | Chervenak | 312/245 X |
| 4,323,213 | 4/1982 | Rock et al. | 248/225.2 |
| 4,329,003 | 5/1982 | Manchester | 312/245 |
| 4,342,439 | 8/1982 | Bruner | 312/245 X |
| 4,457,436 | 7/1984 | Kelley | 248/225.2 X |
| 4,576,355 | 3/1986 | Graf | 312/245 X |
| 5,392,934 | 2/1995 | Fox | 312/245 X |

FOREIGN PATENT DOCUMENTS

| | | | |
|---|---|---|---|
| 246687 | 11/1987 | European Pat. Off. | 312/245 |
| 389054 | 9/1990 | European Pat. Off. | 312/245 |
| 2404411 | 6/1979 | France | 312/245 |
| 2820085 | 11/1979 | Germany | 248/225.2 |

*Primary Examiner*—Peter M. Cuomo
*Assistant Examiner*—Janet M. Wilkens

[57] ABSTRACT

A cabinet hanging apparatus includes an elongated rigid rail member which is adapted to be secured to the surface of a vertical wall in the horizontal position and which has a J shaped extension projecting outwardly from the rail member. The cabinet hanging apparatus also includes an elongated bracket having a hook shaped extension which is positioned and is of a size and shape to interlock with the J shaped extension. The bracket is secured in a recessed back section of a cabinet to be hung at a position where the J shaped extension will engaged the hook shaped extension the cabinet to be supported with the back edges of the cabinet held flush against the vertical wall.

7 Claims, 1 Drawing Sheet

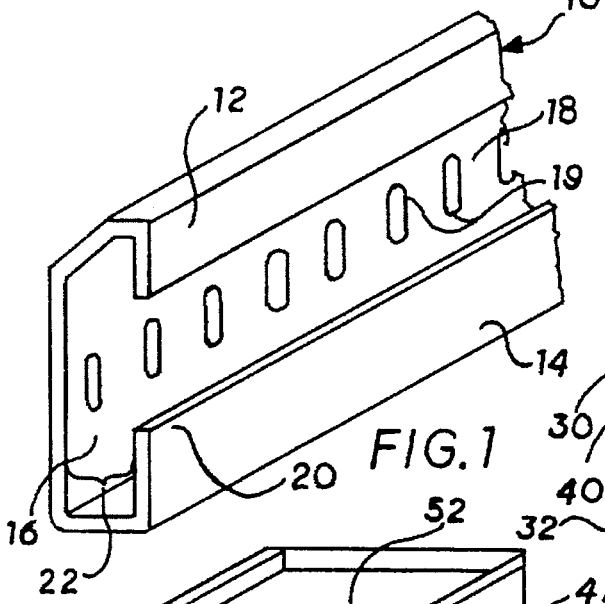
FIG. 1
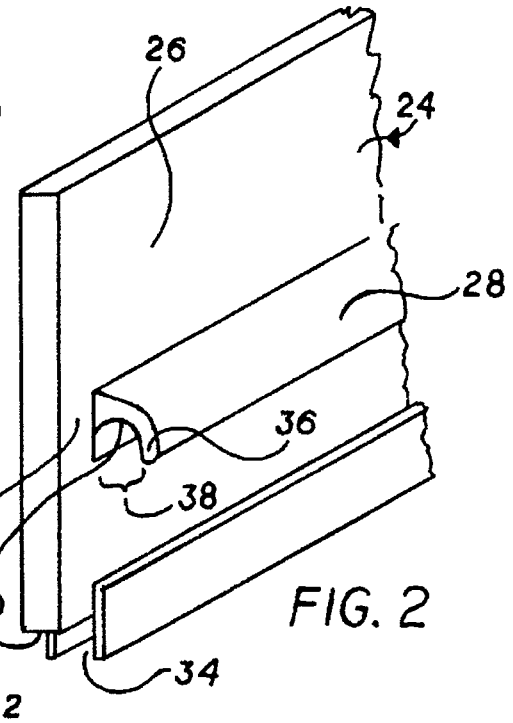
FIG. 2
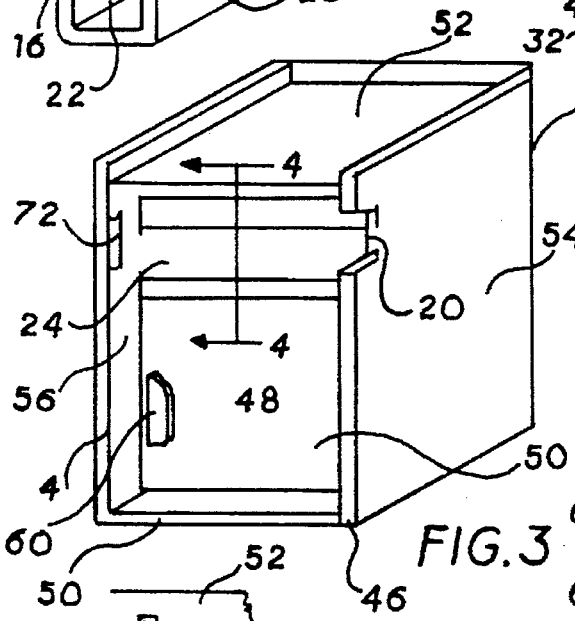
FIG. 3
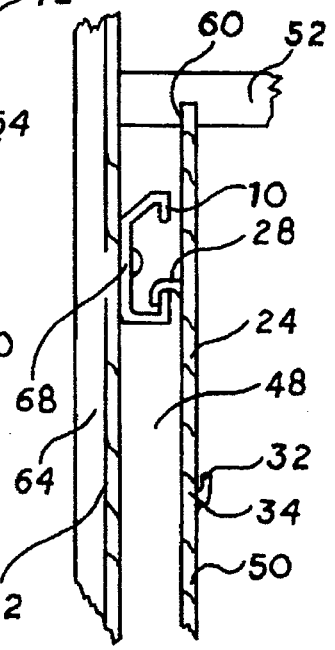
FIG. 5
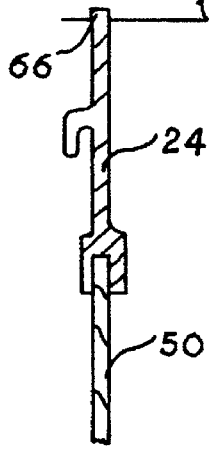
FIG. 4
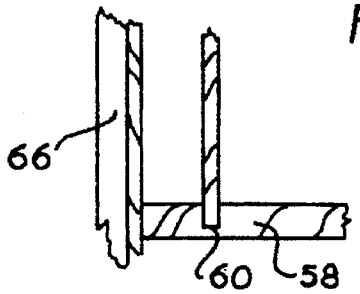

CABINET MOUNTING APPARATUS

BACKGROUND OF THE INVENTION

1. Field of the Invention

This invention relates to a method and apparatus for installing wall cabinets and more particular is concerned with a mounting apparatus for facilitating the accurate placement and secure installation of cabinets on vertical walls.

2. Description of Related Prior Art

Wall mounted cabinets are widely used in home construction. Kitchens typically have a sets of overhead cabinets mounted on the walls. The kitchen cabinets are used for storage of heavy items such as dishes and canned food and accordingly should be securely fastened to the wall. The wall cabinets also have a decorative function in many applications such as in kitchens where it is important the cabinets be mounted flush and level with each other.

Considerable problems are encountered in the installation of wall mounted cabinets. Certain of the problems are the result of the standard construction of the interior walls on which the cabinets are hung. Interior walls are conventionally constructed by installing the supporting studs at regular spaced intervals such as sixteen inches on center. The studs are then covered with sheet rock, wall board, paneling or other similar materials to complete the wall. Wall cabinets on the other hand are made in a range of different widths and typically a combination of different width cabinets are used in a single installation. As a result there usually is little alignment of the cabinets with the underlying studs in the wall. It is therefore often difficult, if not impossible to secure an individual cabinets directly to a stud and obtain the required strength. The cabinets often must be secured to the relatively weak wall covering between the studs which cause a potentially dangerous situation if the cabinet become loose and fall from the wall.

A further problem is that the installation typically required several person; one person to hold the cabinet in position and one person to secure the cabinet to the wall. It also generally required a skilled professional cabinet installer in order to install the cabinets flush and level.

Various suggestion have been made to overcome the above noted problems but the suggestions heretofore made have not been satisfactory. Duggan et al in U.S. Pat. No. 2,708,147 suggested installing a ranged hanger bar on the wall. A mounting bracket having mating square channel was attached to the cabinet. To hang the cabinet, the mating channel of the mounting bracket was slid over the square extension of the hanger bar. The mounting bracket and the hanger bar then had to be locked together with a screw to prevent the cabinet from falling down. The method disclosed by Duggan et al was unsatisfactory because the ranged member spaced the cabinet from the wall which is undesirable and the hanger bar and the bracket do not safely support the cabinet unless mechanically locked together. It was also difficult for one person to install the cabinets in that the cabinet had to be held in position while inserting the locking screw from the inside of the cabinet.

Drass, U.S. Pat. No. 3,950,049, suggested the use of a combination of a support rail counter sunk in the wall on which the cabinet was to be mounted and an interlocking bracket attached to the back of cabinet to hang the cabinet on the rail. More specifically Drass teaches that the rail must be attached directly to the studs of the wall by countersinking the rail into the wall. This done by either attaching the rail first to the studs and then bring the wall covering up to the rail or by removing a section of wall covering from a completed wall to expose the studs and securing the rail in the resulting opening. The method suggested by Drass was unsatisfactory because of the problems and additional cost encountered in installing the rail prior to applying the wall covering or removal of the required wall covering from existing walls and then installing the rail.

Bruner, U.S. Pat. No. 4,342,439, disclosed a method for temporarily hanging cabinets prior to permanently fastening the cabinets by conventional methods. According to Bruner a rail of a bendable material such as sheet metal is attached to the wall on which the cabinet is to be mounted and a similar mating bracket is attached to the cabinet. The cabinet is hung on the rail and temporary held in position. The permanent fastener are then installed and tighten to draw the cabinet against the wall and collapse the temporary hanger. The Bruner method is not suitable for permanent installations in that the disclosed system will not securely hold the cabinets in place under normal conditions.

Laughon et al, U.S. Pat. No. 4,928,913, suggested the use of a rail of a specific cross section and the use of mating cutout on the end panels of a cabinet to hang the cabinet on the rail. This system is unsatisfactory in that it concentrates the entire load on the ends of the cabinet causing a potentially dangerous situation. It was suggested to reenforce the ends with inserts. The use of the inserts and the requirement that the rail go though end of the cabinet resulted in the exposed end of the cabinet being unsightly for finished applications.

What would be highly desirable would be a cabinet mounting apparatus that is can be effectively used by professional cabinet hangers and do-it-your-yourselfers working, would only require one person to install cabinets; would allow cabinets to be hung securely to a wall; level and flush with each other; and flush against a vertical sporting wall.

BRIEF SUMMARY OF THE INVENTION

A cabinet hanging apparatus is disclosed which includes an elongated rigid rail member which is adapted to be secured to the surface of a vertical wall in the horizontal position and which has a J shaped extension projecting outwardly from the rail member. The cabinet hanging apparatus also includes an elongated bracket having a hook shaped extension which is positioned and is of a size and shape to interlock with the J shaped extension. The bracket is secured in a recessed back section of a cabinet to be hung at a position where the J shaped extension will engaged the hook shaped extension the cabinet to be supported with the back edges of the cabinet held flush against the vertical wall.

BRIEF DESCRIPTION OF THE DRAWING

FIG. 1 is an illustration in perspective of a rail member of this invention.

FIG. 2 is an illustration in perspective of a bracket of this invention shown with an end modified to allow insertion into a groove.

FIG. 3 is an illustration in perspective of the back of a cabinet having the bracket of this invention secured in the recessed back of the cabinet.

FIG. 4 is an illustration in cross section taken as indicated by the lines and arrows 4—4 on FIG. 3.

FIG. 5 is an illustration shown in cross section with parts broken away of a cabinet secured to a vertical wall using the apparatus of this invention.

DETAILED DESCRIPTION OF THE PREFERRED EMBODIMENTS

In FIG. 1 there is shown as elongated rail member 10 suitable for use in the present invention. The rail member 10 may be made from a variety of material providing the resulting rail member 10 is relative rigid and strong enough to support a cabinet hung on the rail member 10. A preferred material for the rail member 10 is extruded aluminum in that it is strong, light in weight and corrosion resistant.

The rail member 10 is comprised of an upper edge portion 12, a lower edge portion 14 and central portion 16. Each of the portions 12,14,16 are preferable formed as a single extrudate. The central portion 16 is flat so as to fit flush against a linear surface of a vertical supporting wall. The central portion 16 may include reenforcing ribs (not shown) to provide additional stiffness. The central portion 16 include means for securing the rail member 10 to a wall. As shown in FIG. 1 apertures 18 are formed in the central portion 16 at spaced intervals. The apertures can be round in shaped as for example drilled apertures. It is preferable however if the apertures 18 are oval in shape as this facilitates making minor adjustment and also accommodates screw which are inserted at an angle.

Screws or other suitable fasteners are inserted through the apertures 18 to secure the rail member 10 to the studs in the wall. The installation of of the rail member 10 on a wall having standard spacing of the studs can be simplified by placing indica 19 adjacent selected apertures at fixed measured intervals corresponding to the spacing of the studs.

The lower portion 14 of the rail member 10 is formed in a generally J shaped configuration with the terminal edge 20 being spaced a first predetermined distance 22 from the central portion 16. As illustrated the J shaped configuration is generally square however it could likewise be of a rounded shape or with for example angled sections provided the terminal end 22 is spaced outwardly from the central portion 16 the first predetermined distance 22.

The upper edge portion 12 can be flat like the central portion 16 but is preferable formed into a reenforcing section to add additional rigidity to the rail member 10 to prevent it from bending from a linear alignment during installation. In the preferred embodiment of this invention as shown in FIG. 1 the upper edge portion is formed so as to extend out from the wall and have a flat upper surface on which a level can be placed to assist in the installation of the rail member 10.

In FIG. 2 there is shown a mounting bracket 24 for use in the present invention. The bracket 24 has a support portion 26 extending the length of the bracket 24 and a downwardly directed hook shaped portion 28 extending from and along the length of the support portion 26. The bracket 24 can made from the same material as the the rail member 10 and like the rail member 10 is preferable formed as an extruded aluminum pan. The support portion 26 as illustrated has a narrow cross sectional width but has substantial depth. The width and depth are selected so that the width will fit into a narrow groove as explained below and the depth to provide a beam strength to support the cabinet and its load when the load is applied to the narrow edge of the support portion 26. The bracket 24 is adapted to be secured within a cabinet which is to be mounted. The bracket 24 as shown in FIG. 3 has the end 30 shaped to fit into a mating size groove. The bottom edge 32 has a channel 34 for receiving and holding a panel. The hook shaped portion 28 is of a given size and a shape and the terminal end 36 thereof is spaced a second predetermined distance 38 from the support portion 26 of the bracket 24. The size and shape of the hook shaped portion 28 and the first and second predetermined distances 22,38 are selected so that the hook shaped portion 28 of the mounting bracket 24 member can be inserted into and supported by the J shaped lower edge portion 14 of the rail member 10. The inner surface 40 of the hooked shaped portion 28 is rounded so as to guide the rail member 10 and the bracket 24 member together.

The cabinets 42 which are preferable installed in accordance with this invention have straight vertical back edges 44,46 designed to fit flush against a vertical wall. The cabinets 42 also have a recessed back section 48 foraged by installing the back wall 50 of the cabinet 42 inwardly from the back edges 44,46 of the cabinet 42. The bracket 24 member is secured within the recessed back section 48 of the cabinet 42 at a location inwardly from the vertical back edges 44,46 where when the cabinet 42 is secured on the wall by inserting the hook portion 28 of the bracket 24 into to J shaped lower portion 14 of the rail member 10, the vertical back edges 44,46 of the cabinet 42 are held flush against the wall.

The proper positioning of the bracket 24 within the recessed back of a cabinet is important in order to obtain optimum results with this invention. The positioning of a bracket within an exiting cabinet not specially designed for use in this invention can be very difficult and may require considerable trial and error as well a substantial modification of the cabinet.

It has been found however that with very little change in the conventional methods of manufacture cabinets can produce specifically for use in the present invention. A cabinet especially useful in the present invention is shown in FIGS. 3 and 4. The cabinet 42 is of generally standard construction having a top panel 52, side panels 54,56 and a bottom panel 58 which are secured together. The panels 52,24,26,58 are typically made of wood or a wood composite but can be other material such a steel. A recessed back section 48 is formed by securing the back wall 50 inwardly from the back edges 44,46 of the cabinet 42. In accordance with the preferred embodiment of this invention an aligned set of grooves 60 are cut into the the interior surface of the side panels 54,56 of the cabinet 42 at a measured distance from the back edges 44,46. A partial back wall 50 is inserted into the grooves 60 in the bottom panel 58 and in the top panel 52. Then a bracket 24 having the ends finished as shown in FIG. 2 is inserted and locked in the grooves 60. The back wall 50 fits into the channel 34 of the bracket 24. The grooves 60 are spaced from the back edges 44,46 of the cabinet 42 as noted above to cause the back edges 44,46 of the cabinet 42 to be held flush against a wall when the bracket 24 and rail member 10 are engaged. The aligned grooves 60 are advantageous also form in the interior surface of the top panel 52 and the upper edge of the supporting portion 26 of the bracket 24 positioned in the groove to provide addition alignment of the bracket in the preferred vertical position. The use of the manufactured cabinets 42 described above reduces to a minimum the on site skill and time required to install the cabinets 42.

The method of installing cabinets 42 using the apparatus of this invention consists of several relatively simple steps which can readily be preformed in a professional manner by either a professional cabinet installer or a do-it-yourselfer working alone. The initial step is to secure the rail member 10 to the vertical wall 62 on which the cabinet 42 is to be mounted. The rail member 10 is installed in a level horizontal position at a height where the cabinet 42 will hang at the desired height. This determined be measuring the distance from the of the bracket 24 to the top of the cabinet 42 and then installing the rail member 10 this distance below the desired height of the cabinets. The rail member 10 is relatively rigid so as not to bend when attached to the wall in that if the rail 10 is bent any significant amount it could interfere with the connection of the bracket 24 and the rail member 10. If the wall on which the cabinet is to mounted has significant low spot it is advisable to shim under the rail member 10 at the low spots. The rail member 10 is preferably secured to the studs 64 in the wall 62 with screws 68 or other type of permanent fasteners.

After the rail member 10 is installed, a cabinet 42 having the bracket 24 in place is lifted and guided to cause the hooked shaped portion 28 of the bracket 24 to engage and lock with the rail member 10. The installation of the cabinet now is completed. Additional cabinets can mounted in the same manner. While not required, a screw or the like can be used to lock the bracket 24 and the rail member 10 together.

The cabinet can be mounted flush to the wall using the apparatus of this invention because the rail member 10 and bracket 24 when locked together are positioned within the recess back section 48 of the cabinet 42. The rail member 10 preferable runs in a single piece for the entire length required when mounting multiply cabinets. The rail member 10 is required to pass thought the side panels of the cabinets. This can be provided for by removing the required cutouts 70 when the cabinets are manufactured and providing trim kit for filling exposed ends. An alternative method is to partially machine a slot 72 from inside through the end panels where the part may have to be removed. When the cabinet 42 is installed the required cutouts 70 are removed by completely cutting the slots 72. Alternatively at the end cabinets the rail member 10 can be cut so short as to engage the bracket but not pass through the end panel as the section of the rail member 10 passing through the cabinet side does not support the cabinet. The removable section can then be left hi place to provide a finished exposed end surface.

In describing the present invention specific attention was directed to the specific embodiments as shown in the drawing. It should be appreciated however that shape of the pans and the like can modified. For example an alternate method of securing a bracket to the cabinet is to form the bracket with a right angle mounting surface which can secured to the top panel of the cabinet with screws. Alternate embodiments such as the above while not specifically shown still fall with in the scope of this invention as defined in the following claims.

What is claimed is:

1. An apparatus comprising in combination:

(a) an elongated rigid rail member having an upper edge portion, a lower edge portion and a central portion; said central portion connecting the upper edge portion and lower edge portion and having a flat surface adapted to fit flush against a linear wall surface and means for securing the rail member to a wall; said lower edge portion extending along the length of the rail member and being formed in a generally J shaped configuration spaced outwardly a first predetermined distance from the central portion, (b) a cabinet including (1) elongated rigid bracket having a support portion extending the length of the bracket and a downward hook shaped portion extending along substantially the entire the length of the support portion; said hook shaped portion being of a given size and shape and being spaced a second predetermined distance from the support portion; said first and second predetermined distance and the size and shape of the hook shaped portion being selected so that to the hook shaped portion of the bracket is insertable in and supportable by the J shaped lower edge portion of the rail, (2) said cabinet further having a top panel, side panels and a bottom panel secured together to form top, side and bottom walls of the cabinet, said side and top panels each having an interior side and edges; said cabinet having a recessed back section formed by locating a back wall panel within the interior of the cabinet a third predetermined distance from the back edges of the side panels; the interior sides of the side panels of the cabinet have defined therein aligned grooves of a given width at said third predetermined distance from the back edges of the cabinet; said support portion of the bracket has opposing terminal lengthwise ends and a support edge extending the length of the upper edge of the bracket, said terminal ends having a width substantially equal to the given width; and the bracket being secured in the cabinet by having the terminal ends thereof being inserted and held by the aligned grooves, said bracket being secured within the recessed back of the cabinet at a location where when the rail member is secured horizontally to a vertical wall and the hook shaped portion of the bracket is inserted and supported by the J shaped lower edge portion of the rail member the cabinet will be held in position with the back edges of the cabinet substantially flush against the vertical wall and the third predetermined distance is selected to allow the rail member and the bracket when the cabinet is hung on a wall to be received in the recessed back section of the cabinet.

2. The apparatus according to claim 1 wherein the upper edge of the bracket is in supporting contact with the interior of the top panel.

3. The apparatus according to claim 2 wherein an additional aligned groove is formed in the interior of the top panel and the upper edge of the bracket is inserted into the additional groove.

4. The apparatus according to claim 2 wherein the supporting portion of the bracket has a rectangular cross section with a narrower width than depth and the width is selected to fit into the grooves and the depth is select to provide the required beam strength to support the cabinet when mounted on the rail member.

5. The apparatus according to claim 1 wherein the the upper edge portion of the rail member is shaped to provide additional rigidity to the rail member.

6. The apparatus of claim 1 wherein the mounting means consists of spaced apertures located along the length of the central portion of the rail member.

7. The apparatus according to claim 6 wherein indicia is provided at regular measured intervals alone the length of the rail member.

* * * * *